United States Patent [19]

Cochran

[11] Patent Number: 4,949,861

[45] Date of Patent: Aug. 21, 1990

[54] RECTANGULAR PLASTIC CONTAINER WITH PANEL SUPPORT

[75] Inventor: Donald D. Cochran, Bartlett, Ill.

[73] Assignee: American National Can Company, Chicago, Ill.

[21] Appl. No.: 271,055

[22] Filed: Nov. 14, 1988

[51] Int. Cl.[5] ..... B65D 1/42

[52] U.S. Cl. ..... 220/72; 215/31; 215/1 C; 220/70

[58] Field of Search ..... 215/31, 1 C; 206/519; 220/70, 72, 74, 77

[56] References Cited

U.S. PATENT DOCUMENTS

| | | | |
|---|---|---|---|
| 861,242 | 7/1907 | Edison | 220/72 X |
| 1,268,582 | 6/1918 | Knox | 220/72 X |
| 2,153,365 | 4/1939 | Conner | 220/72 X |
| 2,199,527 | 5/1940 | Sebell | 220/72 X |
| 3,727,783 | 4/1973 | Carmichael | 220/70 X |
| 3,788,511 | 1/1974 | Marsh | 220/72 X |
| 4,113,129 | 9/1978 | Cambio, Jr. | 215/1 C |
| 4,143,784 | 3/1979 | Frahm et al. | 220/72 X |
| 4,759,454 | 7/1988 | Nowicki et al. | 220/70 X |
| 4,782,945 | 11/1988 | Geiler et al. | 215/1 C X |

FOREIGN PATENT DOCUMENTS

| | | | |
|---|---|---|---|
| 2449045 | 10/1980 | France | 220/70 |

*Primary Examiner*—Stephen Marcus
*Assistant Examiner*—Christine A. Peterson
*Attorney, Agent, or Firm*—Robert A. Stenzel; Ralph R. Rath

[57] ABSTRACT

A thin wall blow molded plastic container includes a generally rectangular body, a cylindrical spout, generally flat neck panels tapering from the container body to the spout and container support members integrally formed in the sides and neck panels of the container. At least one first support member is provided on at least two opposed sides of the container which extends from the bottom of the container across the associated neck panel and terminates proximate the spout. Preferably four second support members are provided each of which extends from the top of the container body along an intersection of the neck panels terminating proximate to the spout.

14 Claims, 2 Drawing Sheets

RECTANGULAR PLASTIC CONTAINER WITH PANEL SUPPORT

DESCRIPTION

1. Technical Field

The present invention relates generally to blow molded plastic containers for packaging oil products and relates particularly to integral support members used therein.

2. Background of the Invention

Packaging products in rectangular plastic containers is often preferred over round containers because rectangular containers can be shipped and stored in less space due to their shape.

However, a rectangular shape presents difficulties in blow molding. During the blow molding process, it is more difficult to affect an even distribution of plastic into all areas of a rectangular mold. Consequently, the plastic becomes stretched and may be thinner in areas such as corners or remote panels, thus reducing the strength of the container. This problem is even greater when the container has an offset neck which further decreases the mold symmetry.

Conventional methods employed to overcome this problem have detracted from the commercial viability of a rectangular container. For example: the use of higher strength, more expensive plastics; increasing the overall wall thickness of the container; and, maintaining higher mold temperatures which is not only more expensive may result in degradation of the plastic.

SUMMARY OF THE INVENTION

The present invention provides for a generally rectangular blow molded plastic container which has integral hollow support members. The container has a generally rectangular body, enclosed at one end, a cylindrical spout and a tapered neck portion between the cylindrical spout and the container body.

The present invention provides for lateral support members which extend continuously from the enclosed end of a container along opposed container sides and tapered neck portion then terminating proximate to the base of the cylindrical spout.

The present invention also provides for tapered neck support members which extend from the upper corners of the container body along the tapered neck portion then terminating proximate to the cylindrical spout base.

These structural support elements provide vertical stacking strength for the container and provide anti-paneling strength for the end walls and the tapered neck portion. The support members provide sufficient added strength so that the container wall thickness may be reduced and a less expensive type of plastic may be used to make the container, such as PET or even recycled PET.

In a preferred embodiment of the present invention, horizontal support members are also provided which provide added container strength particularly against horizontal crush forces and structural folding. The horizontal support members are also adapted to allow the proper positioning of a continuous circumferential container label and to present an obstacle to the slidable removal of such a label.

Other advantages and aspects of the invention will become apparent upon making reference to the specification, claims, and drawings to follow.

DETAILED DESCRIPTION OF THE INVENTION

Figure 3:
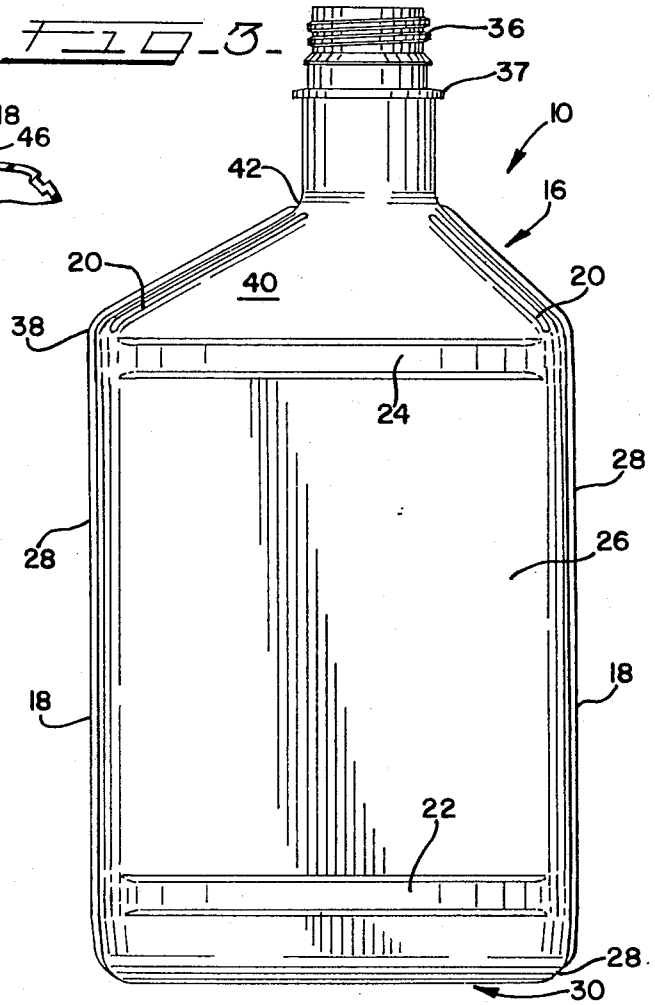
FIG. 3 is a side elevational view of a side wall of the container.

While this invention is susceptible of embodiment in many different forms, there is shown in the drawings and will herein be described in detail preferred embodiments of the invention. The present disclosure is to be considered as an exemplification of the principles of the invention and is not intended to limit the broad aspect of the invention to embodiments illustrated.

Figure 1:
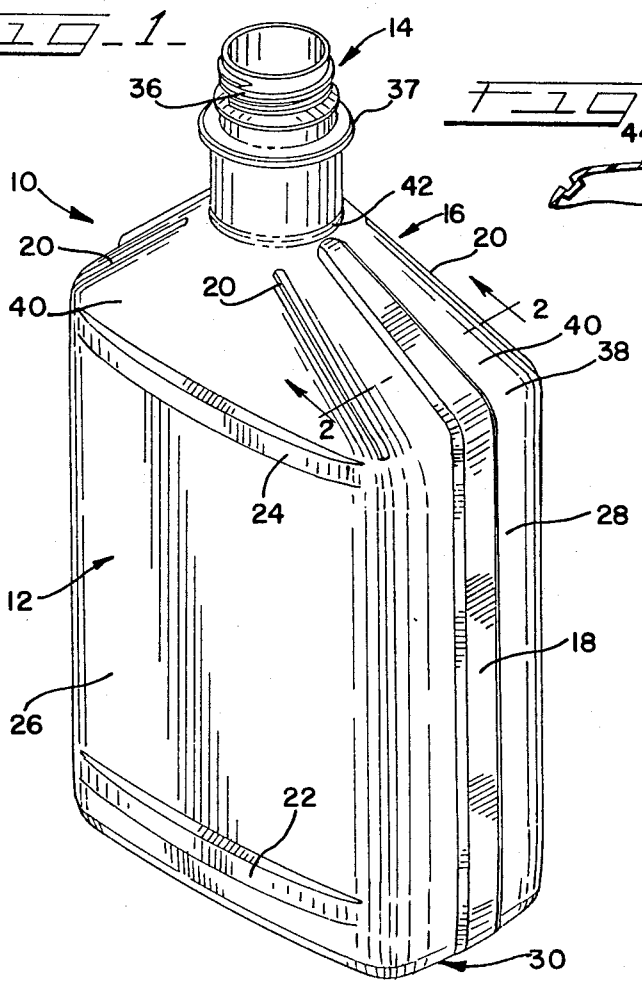
FIG. 1 is a prospective view of the container of the present invention.

Referring now to the drawings, FIGS. 1 through 6 disclose the plastic container of present invention generally referenced by 10. As best depicted in FIG. 1, container 10 includes a generally rectangular container body 12 with an integral bottom wall 30 enclosing the bottom of the container, an open end in the form of an integral cylindrical spout 14 and an integral tapered neck portion 16 between the container body 12 and spout 14.

Container 10 also has integral structural support members in the form of two lateral support members 18, four neck panel support members 20 and label protectors 22, 22 and 24, 24, as will be discussed in more detail below. These structural support elements provide sufficient added strength so that the container wall thickness may be reduced and a less expensive type of plastic may be used to make the container, such as PET or even re-cycled PET.

Figure 4:
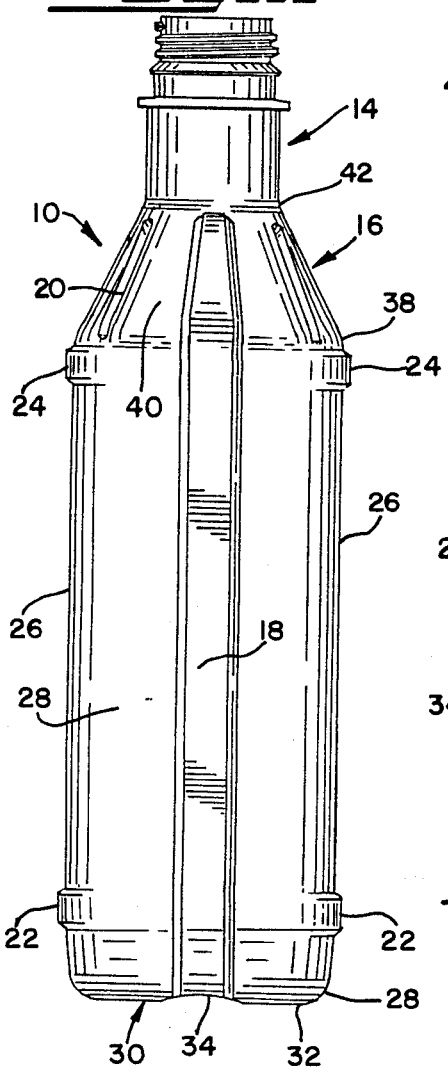
FIG. 4 is a side elevational view of an end wall of the container.
Figure 5:
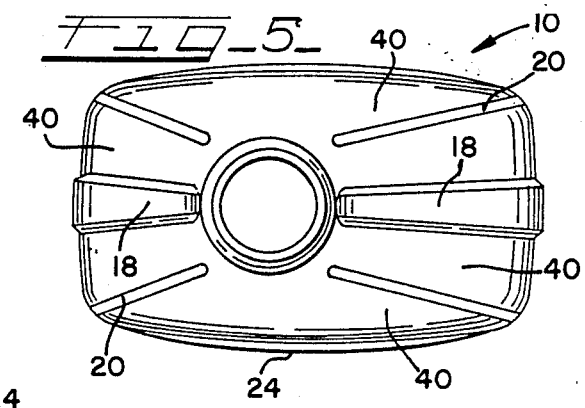
FIG. 5 is an elevational view of the top of the container.
Figure 6:
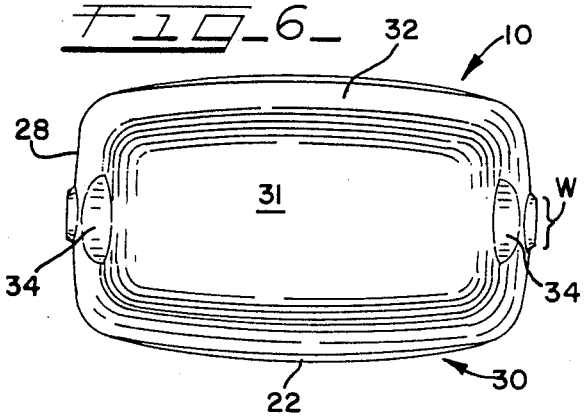
FIG. 6 is an elevational view of the enclosed bottom of the container.

As best disclosed in FIGS. 1, 3 and 4, container body 12 includes rectangular opposed side walls 26, rectangular opposed end walls 28 and a bottom wall 30 enclosing one end of the container body. FIGS. 5 and 6 disclose that side walls 26 and end walls 28 are arcuately disposed outward and intersect at radius corners defining a continuous container wall with a generally rectangular horizontal cross section.

FIGS. 3, 4 and 6 best disclose that bottom wall 30 is generally flat with a central concave portion 31 defining a flat peripheral base portion 32. Bottom wall 30 intersects side walls 26 and end walls 28 at radius corners. The peripheral base portion 32 has integral arcuate channels 34 extending from the radius corners formed at the intersection of bottom wall 30 and end walls 28 to the concave central portion 31. The channels 34 are centered relative to the width of the bottom wall 30.

As disclosed in FIGS. 1, 3 and 4, spout 14 is in the form of a hollow right circular cylinder. Spout 14 has external threads 36 and flange 37 integral with its open end to accommodate at internally threaded closure. In other embodiments spout 14 may be equipped with other means for closure such as a snap-on cap.

Figure 7:
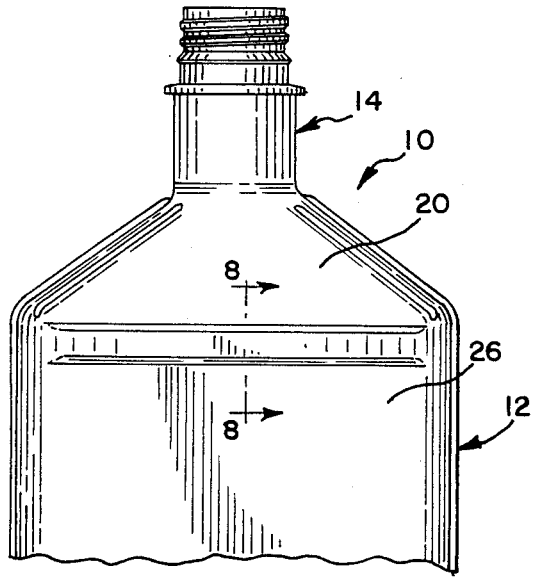
FIG. 7 is a partial side elevation of a container of the present invention having a centered spout.

In one preferred embodiment, as disclosed in FIGS. 1 through 6, the axis of the spout is offset with respect to a vertical axis of container body 12. Particularly, in this preferred embodiment, the axis of the spout is offset with respect to end walls 28 and centered with respect to side walls 26. The container of the present invention provides for added strength in other embodiments where the spout may be centered with respect to both the end walls 28 and side walls 26 as disclosed in FIG. 7 or may be offset with respect to both the end and side walls.

FIGS. 1, 3 and 4 disclose that tapered neck portion 16 includes an inwardly disposed arcuate container shoulder 38 at the end of the continuous container side wall, four generally flat neck panels 40 integral with the container shoulder and an annular arcuate segment between the neck panels and the cylindrical spout 14 defining a spout base 42. The neck panels 40 intersect each other at radius corners and the corners converge toward the cylindrical spout as best disclosed in FIG. 5.

As discussed above and as best depicted in FIGS. 1, 4 and 5, container 10 has integral support members 18 which extend from the enclosed bottom wall 30, continuously along a medial margin of each opposed end wall 28, over container shoulder 38 and further along a medial margin of the neck panel 40 which adjoins each respective end wall, then terminating integrally with spout base 42.

The support members 18 provide vertical stacking strength for container 10 and provide anti-paneling strength for end walls 28 and tapered neck portion 16.

Figure 2:
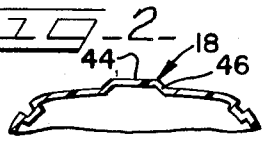
FIG. 2 is a partial cross section of the container taken along line 2—2 of FIG. 1.

FIG. 2 disclosed that support member 18 defines a ridge relative to the container exterior surface and a channel with respect to the container interior surface. FIG. 2 further discloses that each support member 18 has a generally flat lateral base portion 44 and continuous legs 46 integral therewith which are offset at obtuse angles relative to the base portion 44 and end wall 28. The obtuse angles facilitate forming of the support member via a blow molding process and present a smoother exterior surface.

In other embodiments, support members 18 may be recessed sufficiently along a longitudinal portion between bottom wall 30 and container shoulder 38 to accommodate a circumferential container label.

The width of support members 18 (as indicated by W in FIG. 6) can be varied to accommodate varying widths of container side walls 28 and further may be varied to better facilitate forming "into" a die element. In a preferred embodiment, the ends of support members 18 are tapered. The tapered ends are more easily achieved in the blow molding process and present fewer stress concentrations than sharply angled geometries.

FIG. 2 discloses that neck panel support members 20 define integral arcuate channels with respect to the exterior surface of container 10 and arcuate ridges with respect to the container inner surface. Both ends of each support member 20 terminate in the form of a smooth rounded end as best disclosed in FIGS. 4 and 5. The rounded ends are more easily achieved in the blow molding process and present fewer stress concentrations than angled geometries.

As best disclosed in FIGS. 3, 4 and 5, each neck panel support member 20 is integral with one radius corner between neck panels 40. Each support member 20 extends continuously from a point proximate to the end of the continuous container side wall, over the container shoulder 38, then along its respective corner and terminates integral with spout base 42.

The support members 18 and 20 are extended into integration with spout base 42 because the wall thickness at spout base 42 is generally greater due to the nature of the blow molding process. However, in other embodiments, the support members may terminate short of spout base 42 and such embodiments will still provide the improved strength as heretofore disclosed according to the present invention.

As discussed above, a preferred embodiment of the container 10 of the present invention, includes label protectors 22 and 24 integral with each opposed side wall 26. FIGS. 1, 3 and 4 disclose that label protectors 22 and 24 are positioned horizontally with each protector 22 being located proximate to the enclosed end of the container body 12 and each protector 24 being located proximate to the container shoulder 38.

Figure 8:
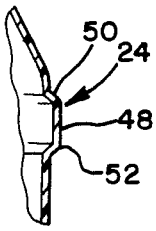
FIG. 8 is a partial cross sectional view of a portion of a label protecting rib of the container taken along line 8—8 of FIG. 7.

FIGS. 5, 6 and 8 disclose that each label protector 22 and 24 is in the form of a generally rectangular, hollow external ridge which tapers arcuately from its midpoint toward each intersection between side walls 26 and end walls 28 where the ridge merges flushly with the radius corners as best disclosed in FIGS. 5 and 6. As best disclosed in FIG. 8, each label protector 22 and 24 has a flat base portion 48 with continuous offset legs 50 which intersect with the base portion at corners 52.

The label protectors are adapted to allow the proper positioning of a continuous circumferential container label and to present an abstacle to the slidable removal of such a label. The label protectors also prevent label scuffing by spacing the container side walls 26 from other containers or surfaces. Furthermore, the label protectors provide added container strength particularly against horizontal crush forces and structural folding.

While the invention has been described with reference to a preferred embodiment, it will be understood by those skilled in the art that various changes may be made and equivalents may be substituted for elements thereof without departing from the broader aspects of the invention.

For example, the container body 12 could be square. There could be provided support members 18 on more than two opposed sides as necessitated by additional strength requirements. Support members 20 could be positioned other than at the radius corners of the neck panels such as through a central portion of the neck panel.

Also, it is intended that broad claims not specifying details of a particular embodiment disclosed herein as the best mode contemplated for carrying out the invention should not be limited to such details.

I claim:

1. A container comprising:

a generally rectangular container body including opposed side walls and opposed end walls, defining a continuous container side wall having a generally rectangular horizontal cross section;

a bottom wall enclosing one end of said container body;

an open end in the form of an extended cylindrical spout and closure means on an upper portion of said spout for cooperably receiving a closure member;

a tapered neck portion between said container body and said extended cylindrical spout;

said tapered neck portion including an inwardly disposed container shoulder at the end of said continuous container side wall, four generally flat neck panels integral with said container shoulder and an annular arcuate segment between said neck panels and said cylindrical spout defining a spout base;

said neck panels intersect at corners and said corners converge toward said cylindrical spout terminating integrally in said spout base;

at least one first support member integral with and extending continuously along each said opposed end wall from said enclosed end over said shoulder and further along said tapered neck portion terminating proximate to said spout; and, at least one second support member integral with each neck panel, said second support members extending from said side wall continuously over said container shoulder and further along said tapered neck portion terminating proximate to said spout.

2. A container as defined in claim 1, wherein said spout having a vertical axis collinear with a vertical axis of said container body.

3. A container as defined in claim 1, wherein said spout having a vertical axis offset with respect to a vertical axis of said container body.

4. A container as defined in claim 1, wherein said second support members are collinear with said corners of said neck panels.

5. A container as defined in claim 1, wherein said first support members define a channel with respect to an inner surface of said container and define a ridge with respect to an outer surface of said container; and, said second support members define a ridge with respect to said inner surface of said container and define a channel with respect to said outer surface of said container.

6. A container as defined in claim 4, wherein said first support members define a channel with respect to an inner surface of said container and define a ridge with respect to an outer surface of said container; and, said second support members define a ridge with respect to said inner surface of said container and define a channel with respect to said outer surface of said container.

7. A thin walled, blow molded, plastic container comprising:

a container body including opposed side walls and opposed end walls, said side walls and said end walls being generally rectangular and being disposed arcuately outward and intersecting at radius corners defining a continuous container side wall having a generally rectangular horizontal cross section;

a bottom wall enclosing one end of said container body and intersecting said continuous side wall at radius corners;

an open end in the form of an extended cylindrical spout and means on an upper portion of said spout for cooperably receiving a closure member;

a tapered neck portion between said container body and said extended cylindrical spout;

said tapered neck portion including an inwardly disposed arcuate container shoulder at the end of said continuous container side wall, four generally flat neck panels integral with said container shoulder and an annular arcuate segment between said neck panels and said cylindrical spout defining a spout base;

said neck panels intersect at radius corners and said corners converge toward said cylindrical spout;

at least one first support member integral with and extending continuously along each said opposed end wall from said enclosed end over said shoulder and further along said tapered neck portion terminating proximate to said spout; and, at least one section support member integral with each said radius corner between said neck panels, said second support members extending from said side wall continuously over said container shoulder and further along said tapered neck portion terminating proximate to said spout.

8. A container as defined in claim 7, wherein a vertical axis of said cylindrical spout is offset with respect to a vertical axis of said container body.

9. A container as defined in claim 7, wherein a vertical axis of said cylindrical spout is collinear with a vertical axis of said container body.

10. A container as defined in claim 7, wherein said closure means including external threads integral therewith for removably securing a closure with mating internal threads.

11. A container as defined in claim 7, wherein a central portion of said bottom wall is concave.

12. A container as defined in claim 7, including at least one integral channel extending across a portion of said bottom wall.

13. A container as defined in claim 7, including label protecting means for protecting a label on said container body from scuffing or removal.

14. A container as defined in claim 7, including an upper and a lower support rib on each said container side wall defining label protectors;

said support ribs being positioned horizontally with each lower support rib being located proximate to said enclosed end of said container body and each upper support rib being located proximate to said container shoulder; and, each support rib is in the form of a generally rectangular, hollow, ridge which is raised with respect to an outer surface of said side wall and tapers arcuately from a midpoint thereof toward said radius corners between said side walls and said end walls where said ridge merges flushly with said radius corners.

* * * * *

UNITED STATES PATENT AND TRADEMARK OFFICE

CERTIFICATE OF CORRECTION

PATENT NO. : 4,949,861

DATED : August 21, 1990

INVENTOR(S) : Donald D. Cochran

It is certified that error appears in the above-identified patent and that said Letters Patent is hereby corrected as shown below:

Column 4, Line 35, delete "abstacle" and insert --obstacle--.

Signed and Sealed this

Seventeenth Day of March, 1992

*Attest:*

HARRY F. MANBECK, JR.

*Attesting Officer*

*Commissioner of Patents and Trademarks*